US005387117A

United States Patent [19]

Moyher, Jr. et al.

[11] Patent Number: 5,387,117

[45] Date of Patent: Feb. 7, 1995

[54] UNIVERSAL CENTRAL VACUUM CLEANER HOSE END FITTING

[75] Inventors: George C. Moyher, Jr., Bluff City, Tenn.; Randall D. Gill, Bristol, Va.; Peter Hoekstra, Bristol, Tenn.; Leonard E. Bowerman, Abingdon, Va.; Jeffrey H. Ingerman, West Orange, N.J.

[73] Assignee: Electrolux Corporation, Atlanta, Ga.

[21] Appl. No.: 151,289

[22] Filed: Nov. 12, 1993

[51] Int. Cl.[6] ..... H01R 4/60

[52] U.S. Cl. ..... 439/191; 15/314; 439/171

[58] Field of Search ..... 439/191–195, 439/171, 173, 174; 15/314

[56] References Cited

U.S. PATENT DOCUMENTS

| | | | |
|---|---|---|---|
| 2,957,156 | 10/1960 | Gatto et al. | 439/166 |
| 3,034,085 | 5/1962 | Pauler et al. | 439/191 |
| 3,258,553 | 6/1966 | Breslin | 200/51 |
| 4,094,535 | 6/1978 | Minton | 285/7 |
| 4,188,081 | 2/1980 | Holden et al. | 439/192 |
| 4,758,170 | 7/1988 | Hayden | 439/142 |
| 4,895,528 | 1/1990 | Choiniere et al. | 439/191 |
| 5,004,428 | 4/1991 | Hayden | 439/191 |

FOREIGN PATENT DOCUMENTS

| | | |
|---|---|---|
| 917704 | 12/1972 | Canada . |
| 1103718 | 6/1981 | Canada . |
| 1147372 | 5/1983 | Canada . |
| 1244501 | 11/1988 | Canada . |

*Primary Examiner*—Gary F. Paumen
*Attorney, Agent, or Firm*—Fish & Neave

[57] ABSTRACT

A "universal" end fitting for a central vacuum cleaner hose, having a reversible electrical connector body that can be reversed without being disconnected from the end fitting, and which accordingly need not be re-aligned after being reversed, is provided. The connector body is permanently but rotatably affixed to the end fitting. Because it is permanently affixed, the connector body need not be realigned after being rotated to a new position.

24 Claims, 6 Drawing Sheets

FIG. 1
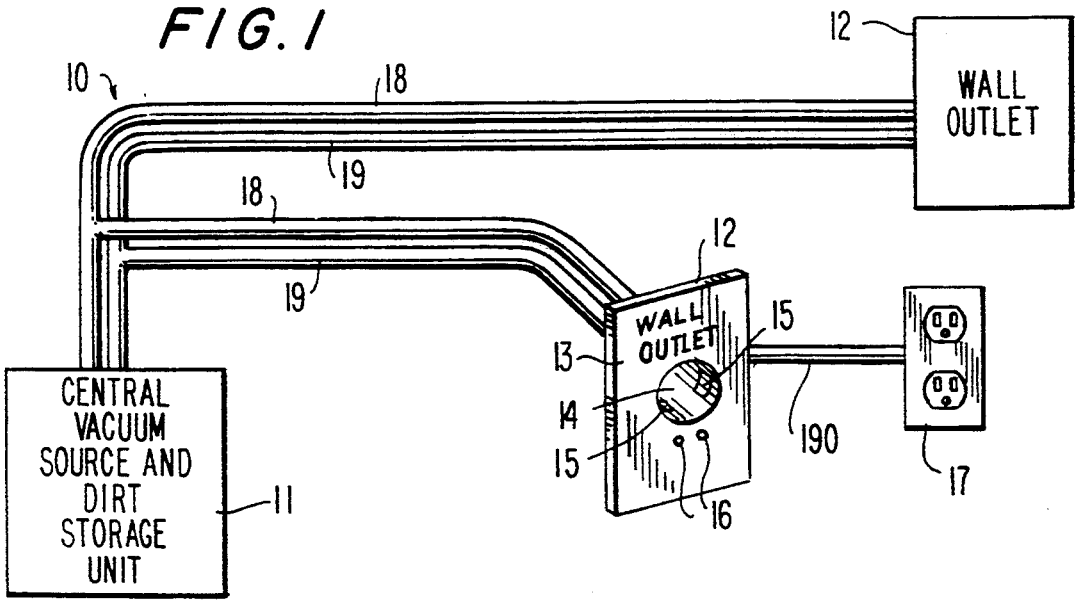
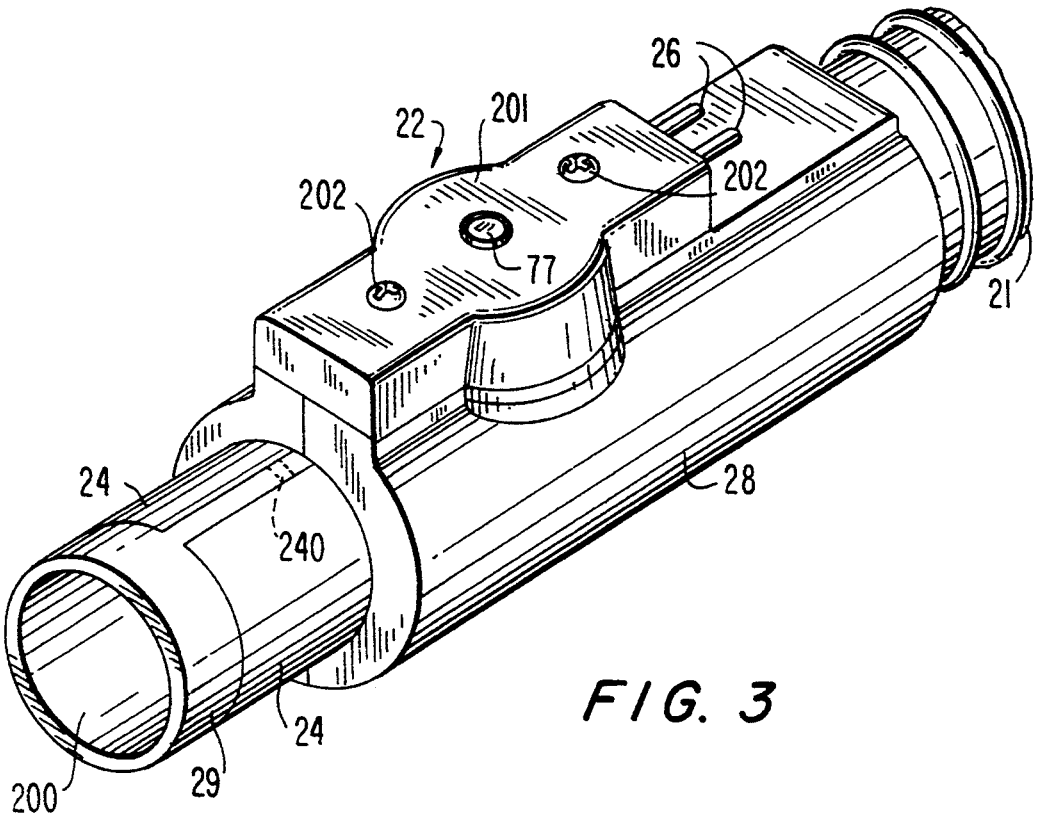
FIG. 3

FIG. 4
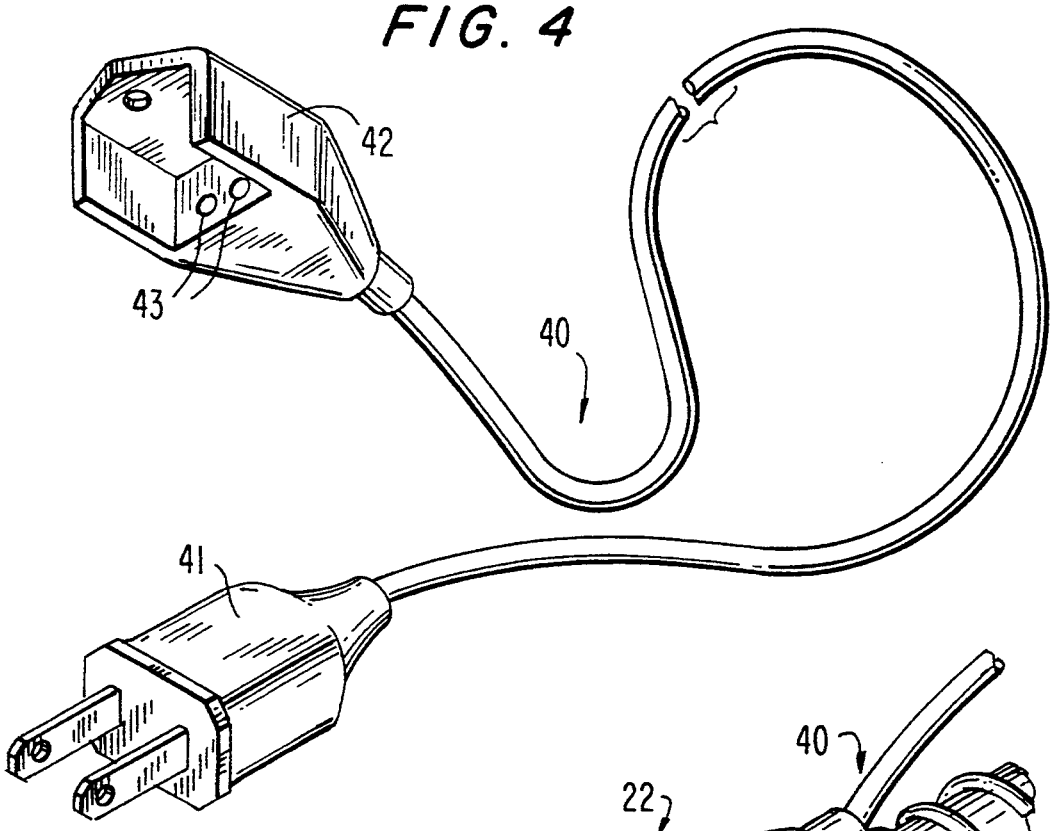
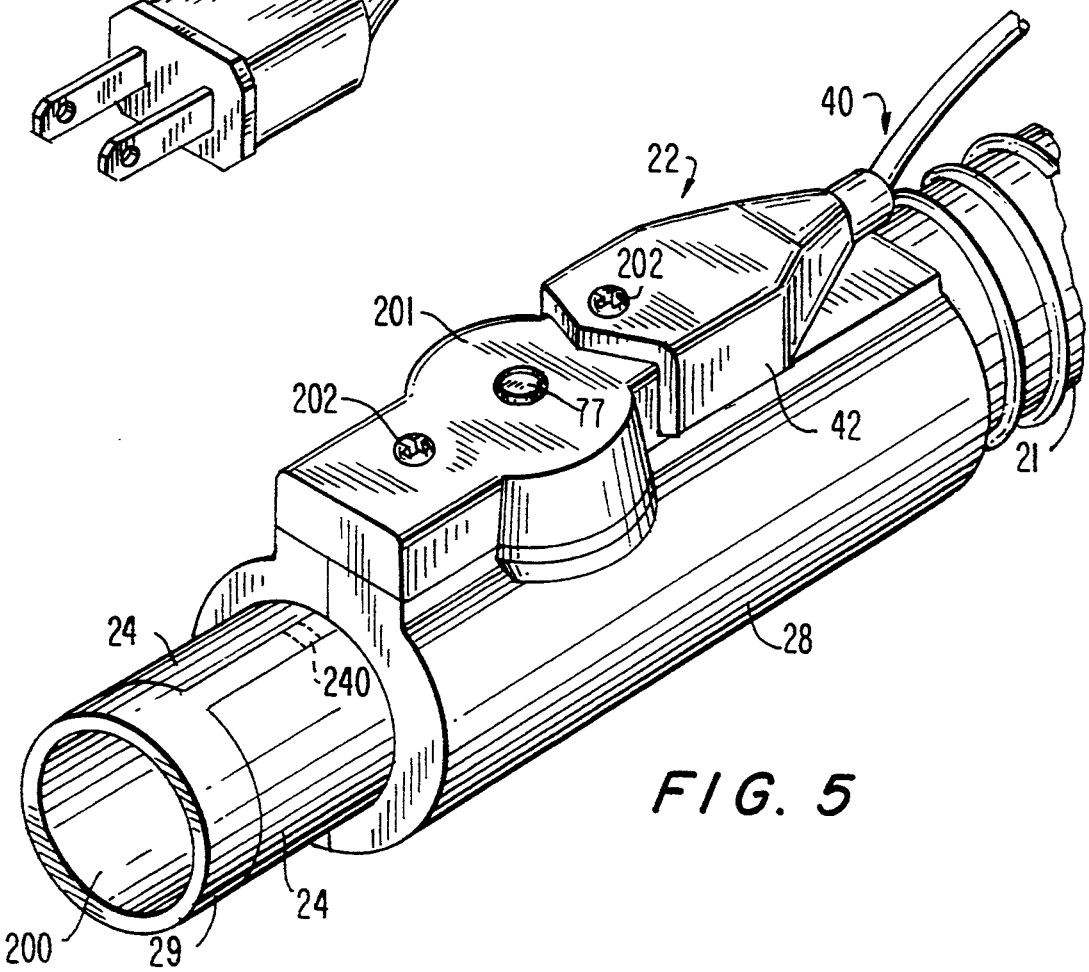
FIG. 5

UNIVERSAL CENTRAL VACUUM CLEANER HOSE END FITTING

BACKGROUND OF THE INVENTION

This invention relates to an end fitting for a central vacuum cleaner hose. More particularly, this invention relates to a universal end fitting for a central vacuum cleaner hose that can be used in installations in which electrical power for accessories is provided through the central vacuum cleaner wall outlets, as well as installations in which electrical power for accessories must be provided separately.

A central vacuum cleaner system installed in a house (or other building) typically includes a vacuum source and dirt collection apparatus in a central location, such as the basement of the house, connected by ductwork to vacuum cleaner wall outlets located strategically throughout the house (e.g., one outlet per room). The user goes from room to room—or, more accurately, from outlet to outlet—carrying only a vacuum cleaner hose and an array of common vacuum cleaner attachments (e.g., wand sections, floor brush, dusting brush, upholstery brush), for which a special caddy may be provided. Thus, the user need not carry a heavy vacuum cleaner canister around the house.

Each vacuum cleaner outlet includes a vacuum port which communicates with the ductwork in the wall and with the fluid passage of the hose to provide suction cleaning air to the attachment at the other end of the hose. Each outlet also typically includes two contacts to low voltage (usually direct-current) control conductors for actuating the central vacuum cleaner system. The system can be set up so that corresponding contacts on the hose end fitting electrically connect together (i.e., "short") the two contacts in the wall outlet, activating the central vacuum apparatus on insertion of the end fitting into the outlet. Alternatively, the system can be set up so that the contacts on the hose end fitting are connected to conductors in the hose that in turn connect to a switch at the far end of the hose, allowing the user to activate and deactivate the system at the point of actual use, away from the outlet.

In addition to the passive vacuum cleaner attachments mentioned above, the system may include a floor and carpet cleaning attachment with a powered brush for agitating the carpet to extract more dirt, again similar to the same type of attachment used with ordinary canister vacuum cleaners. If such an attachment is provided, a way must be provided to supply electrical power to the powered attachment, which normally requires an ordinary household alternating-current supply.

One solution is to provide a separate power cord on the attachment itself which can be attached by the user directly to an ordinary household electrical outlet. However, that would require the user to manage both the hose and the separate power cord, each of which could be trailing in a different direction. In addition, manufacturers of such attachments frequently also provide such attachments for canister vacuum cleaners, and it is therefore desirable that the same attachment can be used with both types of systems. Accordingly, it is preferable for the electrical supply for the attachment to be provided through conductors in the hose, as it is with canister vacuum cleaners.

Two schemes for providing power through a central vacuum cleaner hose to an attachment are commonly used. In one scheme, the central vacuum cleaner wall outlet has a second set of contacts—usually recessed female contacts for safety reasons—connected to a supply of ordinary household power. A mating plug—usually male—in the hose end fitting engages the power contacts in the wall outlet and connects to the power conductors in the hose.

In the second scheme, the wall outlet is not provided with power contacts. For example, if the central vacuum cleaner system is being installed in an existing house, rather than as part of new construction, it may be difficult to run power lines through the walls in addition to the central vacuum cleaner duct. In the second scheme, then, the male contacts on the hose end fitting face away from the wall, and an auxiliary power cord is provided to connect at one end to the male contacts and at the other end to an ordinary household electrical outlet.

It is known to provide central vacuum cleaner hose end fittings with contacts that can be configured to connect either to power contacts in the central vacuum cleaner wall outlet or to an ordinary electrical outlet. This has the advantage that manufacturers can supply a single type of hose that can be configured at the point of sale or installation. Configuration by the user is usually not necessary, as the user will generally have either one type of vacuum system outlet or the other. It is generally sufficient that the installer configure the end fitting once.

Known "universal" hose end fittings, as these adjustable fittings are called, typically include an electrical connector body having two prongs connected to power conductors in the hose. The connector body can be detached from the hose—either by disassembling the end fitting or by releasing a screw or similar fastener—reversed in direction, and reattached (the conductors are never disconnected). This requires that the connector body be realigned, so that the prongs protrude the correct distance in the correct direction to mate with the female contacts in the outlet.

It would be desirable to be able to provide a central vacuum cleaner hose end fitting having a reversible electrical connector body that can be reversed without being disconnected from the end fitting, and which accordingly need not be realigned after being reversed.

SUMMARY OF THE INVENTION

It is an object of this invention to provide a central vacuum cleaner hose end fitting having a reversible electrical connector body that can be reversed without being disconnected from the end fitting, and which accordingly need not be realigned after being reversed.

In accordance with the present invention, there is provided an end fitting for a first end of a central vacuum cleaner hose for connecting the hose to a wall outlet of a central vacuum cleaner system. The wall outlet has a vacuum port. The hose has a fluid passage and has conductors for transmitting electrical power from the first end thereof to an accessory at a second end thereof. The end fitting comprises a body having a bore therethrough, the body having a hose end at which the hose is attached with the bore in fluid communication with the fluid passage, and having a wall end opposite the hose end for insertion into the vacuum port. The end fitting also includes an electrical connecting portion on the body. The connecting portion has a plurality of contacts each electrically connected to one of the conductors, and is rotatably and permanently affixed to the body for rotation between a first position in which the contacts face the wall end of the body for use when the wall outlet has a source of electrical power for supplying electrical power to the accessory, and a second position in which the contacts face the hose end of the body for use with an auxiliary power cord for supplying electrical power to the accessory from a source spaced from the wall outlet.

BRIEF DESCRIPTION OF THE DRAWINGS

The above and other objects and advantages of the invention will be apparent upon consideration of the following detailed description, taken in conjunction with the accompanying drawings, in which like reference characters refer to like parts throughout, and in which:

FIG. 1 is a schematic view of a central vacuum cleaner system;

FIG. 3 is a perspective view of a hose end fitting according to the present invention in a second configuration;

FIG. 4 is a perspective view of an auxiliary power cord for use with the configuration of FIG. 3;

FIG. 5 is a perspective view similar to FIG. 3 with the power cord of FIG. 4 attached;

DETAILED DESCRIPTION OF THE INVENTION

Figure 2:
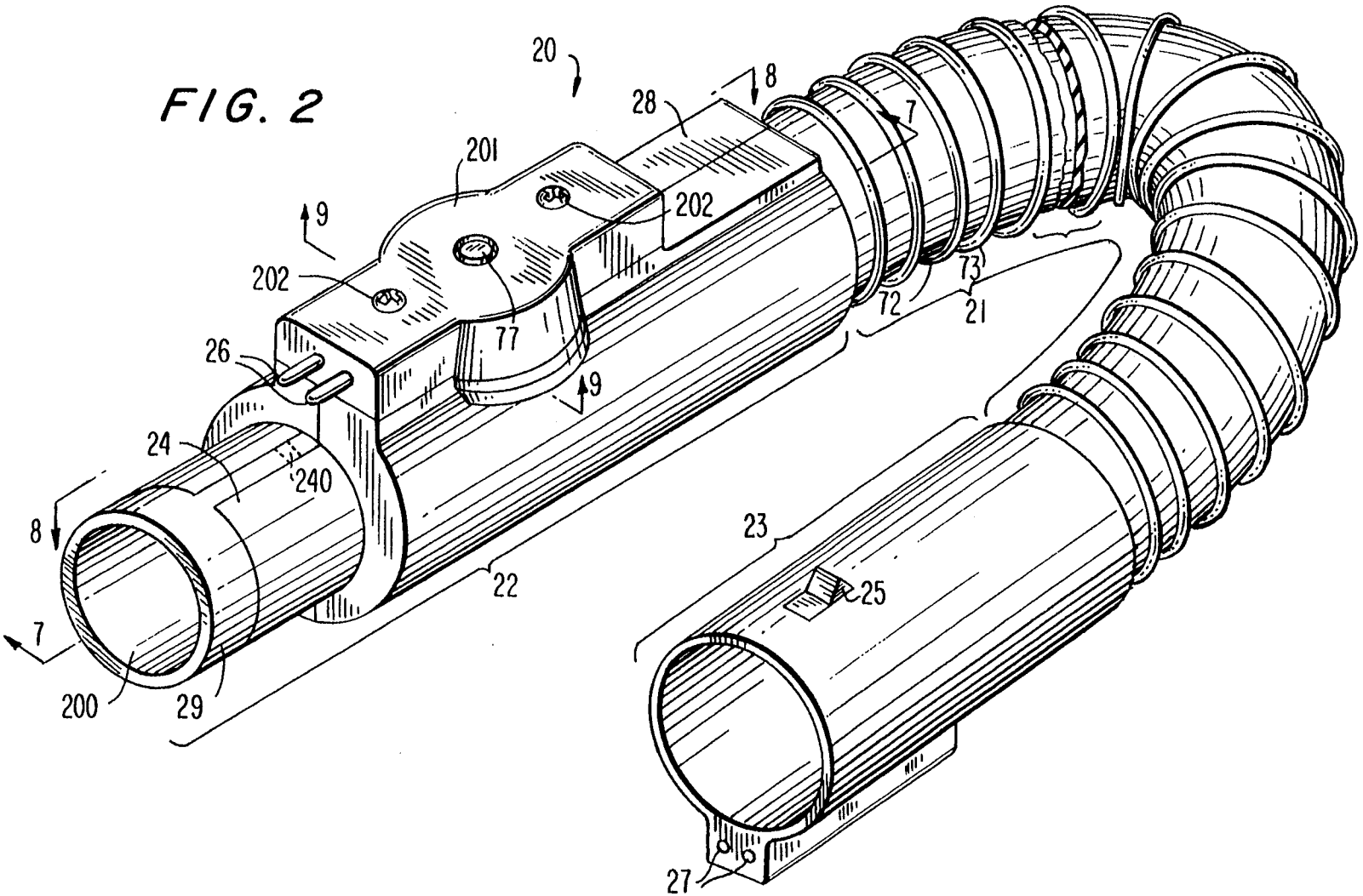
FIG. 2 is a perspective view of a central vacuum cleaner hose incorporating an end fitting according to the present invention, with the hose end fitting in a first configuration.

The present invention is a hose end fitting for use in a central vacuum cleaner system. The end fitting is for use with a hose having conductors for carrying electrical power from the end fitting to an accessory at the other end of the hose. The end fitting can be used where electrical power for the accessory is provided by power contacts in the wall outlets of the central vacuum cleaner system, or where electrical power must be obtained from an ordinary household electrical outlet, as discussed above.

The ability of the end fitting to accept electrical power from either contacts in the wall outlet or a household electrical outlet is achieved by providing an electrical connecting body or portion that is permanently but rotatably attached to the end fitting. The electrical connecting portion preferably has two male prongs that can be mated either to female contacts in the vacuum cleaner wall outlet or to female contacts in one end of an auxiliary power cord, the other end of the auxiliary power cord having an ordinary male electrical plug for connection to a household electrical outlet. When the end fitting is to be used with a system in which the vacuum cleaner wall outlets have power contacts, the electrical connecting portion is rotated so that the male prongs face toward the wall end of the hose. When the end fitting is to be used with a system in which the vacuum cleaner wall outlets do not have power contacts, the electrical connecting portion is rotated so that the male prongs face away from the wall end of the hose, so that the prongs are accessible for the attachment of an auxiliary power cord that can be plugged into a household electrical outlet.

Although the electrical connecting portion is rotatable, it is nevertheless permanently affixed to the hose end fitting. Thus the electrical connecting portion need only be rotated from one position to the other, without the need for additional alignment, to place the male prongs in the correct position for the intended use. In the preferred embodiment, the permanent rotatable connection is provided by a polymeric spindle or post which passes through an opening in the electrical connector portion and then is heat-staked or ultrasonically welded to prevent removal of the electrical connecting portion from the post.

It is not expected that the end user will be adjusting the electrical connecting portion of the hose end fitting. It is envisioned that in substantially all cases, all of the vacuum cleaner wall outlets in a given user's home will be of the same type. Thus, for a given end user, the electrical connecting portion will remain in one position. That position will be set by the supplier or installer of the system. The supplier may maintain an inventory of hoses with end fittings adjusted both ways, and will provide a correctly adjusted hose for the type of system installed. Alternatively, the supplier will always supply the hose in the same configuration and will also supply the auxiliary power cord regardless of the type of installation, and the installer will adjust the electrical connecting portion and, if necessary, attach the auxiliary power cord.

In the preferred embodiment, the power conductors in the hose are directly connected to the electrical connecting portion, with sufficient slack provided in the conductors to allow for rotation of the electrical connecting portion. It is therefore preferred that rotation of the electrical connecting portion be limited, and in the preferred embodiment a stop is provided to limit the rotation to a 180° range, as explained below. Of course, the connection between the hose conductors and the electrical connecting portion could be achieved with brushes and commutator rings, or other sliding contacts, in which case the rotation would not have to be limited. In any case, it is preferable that one or more fasteners be provided to rotationally fix the electrical connecting portion after it has been adjusted. The fasteners are preferably removable to allow for readjustment of the electrical connecting portion by service personnel, if necessary.

A central vacuum cleaner system 10 of the type with which the present invention is intended to be used in shown schematically in FIG. 1. System 10 includes a central vacuum source and dirt storage unit 11, typically located in an out-of-the-way area of a home, such as in a basement or other utility area. System 10 also includes a plurality of vacuum cleaner wall outlets 12, one of which is shown schematically in FIG. 1, and the other of which is shown in an exterior perspective view in which only the portions that can be seen by the user outside the wall are visible. Those portions include a wall plate 13 in which there is a vacuum port 14. Inside vacuum port 14 are two low-voltage control contacts 15 which connect to the control circuitry (not shown)

of system 10, for actuating system 10 in the manner discussed above. Finally, recessed female contacts 16 may optionally be provided in outlet 12, for supplying ordinary household alternating-current power to a vacuum cleaner accessory, also as discussed above. Vacuum cleaner wall outlet 12 may be installed near a conventional household electrical outlet 17, which is particularly preferable where contacts 16 are not provided.

Vacuum cleaner wall outlets 12 are connected to central vacuum source and dirt storage unit 11 by vacuum lines 18, which connect directly to ports 14 and carry dirt-laden suction air from hose 20 (FIG. 2) back to central unit 11. Unit 11 and wall outlets 12 are also connected by electrical cables 19, which carry control conductors that terminate at contacts 15. In installations in which power contacts 16 are also provided, contacts 16 may be supplied by power cables 190 connected to the wiring (not shown) supplying a nearby conventional household electrical outlet 17. It is understood that in most installations, wall outlet 12 will not be far from a conventional household electrical outlet 17. This makes it relatively easy to route power cables 190, and it is also convenient for installations in which contacts 16 are not provided, because the user will not have to go far to find a place to connect the auxiliary power cord 40 (FIG. 4).

A preferred embodiment of a vacuum cleaner hose 20, of the type used with system 10 and incorporating the present invention, is shown in FIG. 2. Hose 20 has a carcass 21, an end fitting 22 according the present invention at one end of carcass 21, and a handle/connector 23 at the other end of carcass 21. In the preferred embodiment, as shown in more detail in FIG. 7, carcass 21 has an inner layer 70 and an outer layer 71, both preferably made of polymeric material, between which are two helical reinforcing supports 72, 73, preferably made of low carbon steel. Supports 72, 73 preferably have the same helical pitch and are offset by half that pitch, so that every other support convolution belongs to a different one of supports 72, 73. Control conductors 74 preferably run alongside support 72 and terminate at one end at control contacts 24 of hose end fitting 22. At their other end, control conductors 74 terminate at switch 25 of handle/connector 23, allowing the user to control central unit 11. Of course, as described above, contacts 24 may optionally be shorted together, as at 240, with unit 11 actuated by insertion of fitting 22.

Similarly, power conductors 75 preferably run alongside support 73, terminating at one end at prongs 26 of fitting 22, and at the other end at recessed female contacts 27 of handle/connector 23. Corresponding male contacts (not shown) on the power accessory (not shown) engage contacts 27 to provide power to the power accessory. Power conductors 75 may also be controlled by switch 25, allowing the user to control not only central unit 11 but also the accessory. Alternatively, a second switch (not shown) could be provided to control power conductors 75 (and the power accessory), separately from control conductors 74 (and central unit 11). Similarly, it may be that only power conductors 75 are controlled by switch 25, with control conductors 74 being controlled by the insertion of fitting 22 into, or its removal from, outlet 12.

It should be understood that handle/connector 23 as shown is a simplified illustration of a vacuum cleaner hose handle. A more particularly preferred handle is shown and described in copending, commonly-assigned U.S. patent application Ser. No. 08/053,250, and in copending, commonly-assigned U.S. design patent application Ser. No. 29/007,474, each filed Apr. 23, 1993, and each hereby incorporated by reference in its entirety.

Hose end fitting 22 is a universal hose end fitting according to the present invention, and is shown in FIGS. 2–9. Hose end fitting 22 preferably has a body 28 from which extends a nozzle 29 for mating with port 14 of outlet 12. Suction air passage 200 extends through nozzle 29, body 28, carcass 21 and handle/connector 23. Nozzle 29 also bears on its outer surface control contacts 24 as discussed above.

Figure 6:
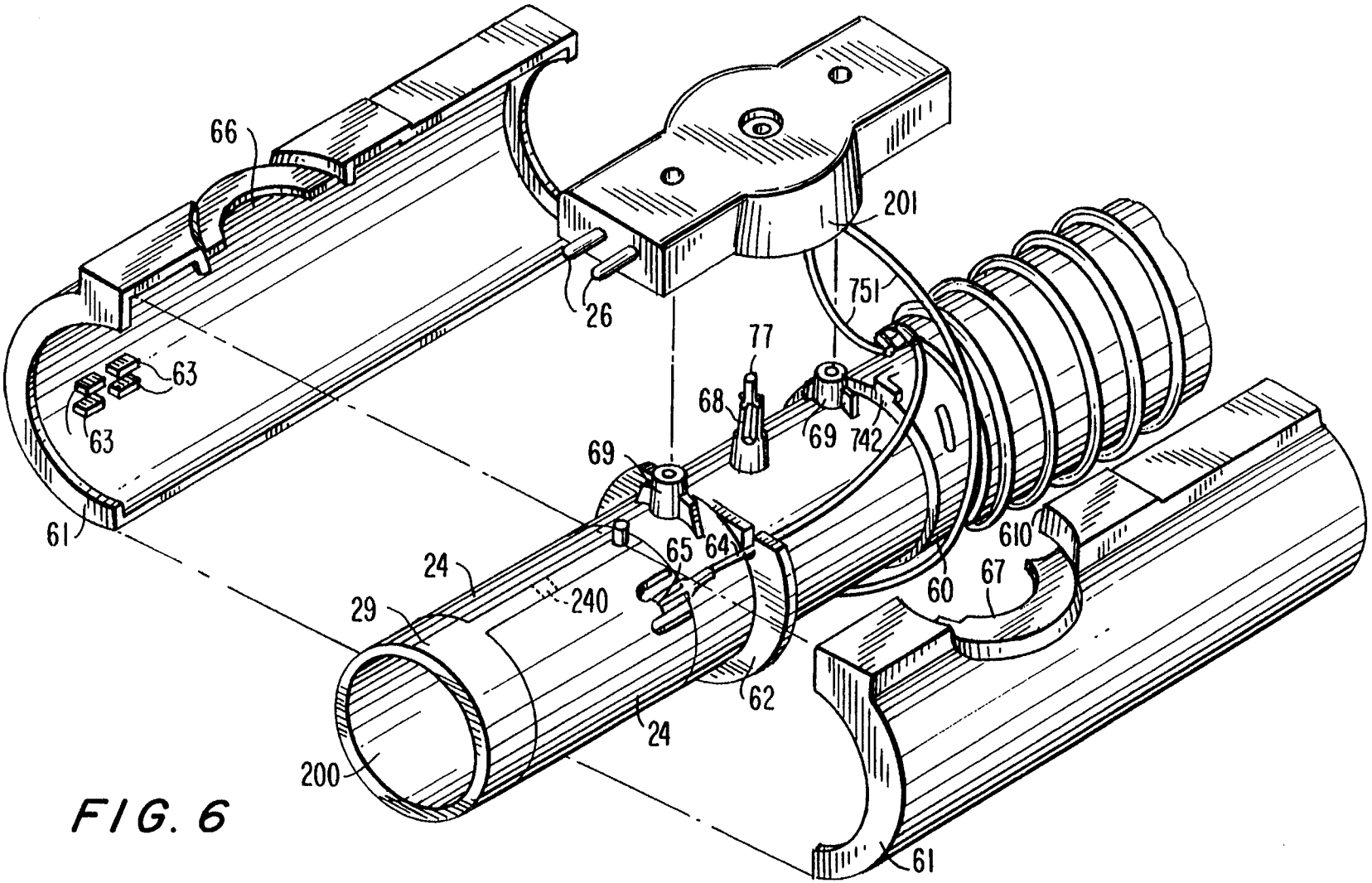
FIG. 6 is an exploded perspective view of a hose end fitting according to the present invention.

As seen in FIG. 6, nozzle 29 is preferably the extension of a connector barrel 60, preferably of a polymeric material such as nylon, onto which hose carcass 21 is attached. Barrel 60 is preferably surrounded by two body halves 61 which together form shell or body 28. A flange 62 on barrel 60 preferably cooperates with tabs 63 on each body half 61 (visible on only one half) to align and stabilize body halves 61 relative to barrel 60. End 741 of one of conductors 74 preferably passes through a slot 64 in flange 62 and is connected to one of contacts 24 by terminal 65. End 742 of the other conductor 74 preferably passes through a similar slot (not shown) on the diametrically opposite side of barrel 60 and connects to the other contact 24. Ends 751 of conductors 75 preferably pass through an opening 80 in body 28, preferably formed by substantially semicircular openings 66, 67 in body halves 61, and connect to rotatable electrical connecting portion 201.

Figure 7:
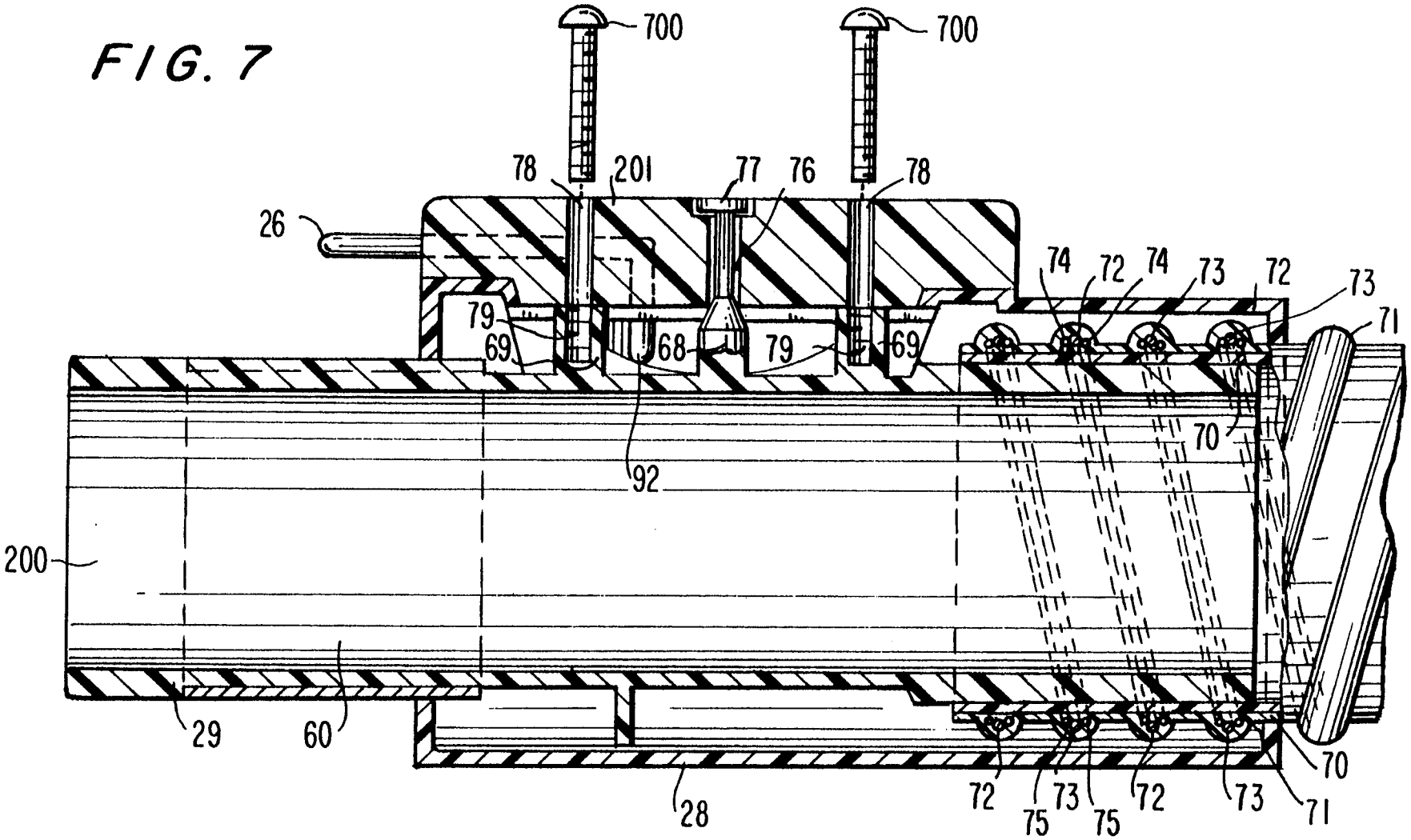
FIG. 7 is a partially exploded cross-sectional view of a hose end fitting according to the present invention, taken from line 7—7 of FIG. 2.

Rotatable electrical connecting portion 201 is preferably made from a polymeric material such as polyvinyl chloride ("PVC"), and is preferably symmetrically shaped except for the presence at one end of prongs 26, the other end being substantially flat. Portion 201 has a central bore 76 through which a post 68 extends from barrel 60. Post 68 is preferably made from the same material as barrel 60 and is preferably molded unitarily with barrel 60. Tip 77 of post 68 preferably extends beyond the end of bore 76, and preferably is heat-staked or ultrasonically welded, causing it to flatten out as shown in FIG. 7, so that it is larger than the diameter of bore 76, thereby preventing the removal of portion 201 while allowing it to rotate. Portion 201 preferably has additional bores 78 which line up with bosses 69 of barrel 60. Appropriate fasteners 202, such as screws 700 (FIG. 7) can be inserted through bores 78 into bosses 69, which could have threaded bores 79, to prevent rotation of portion 201 once its desired orientation has been set.

Each end 751 of respective conductor 75 preferably connects, via a respective one of terminals 90 lying in a respective one of channels 91, to a respective one of electrically conductive posts 92 which is connected to a respective one of prongs 26. As portion 201 is rotated, the slack in ends 751 allows conductors 75 to follow the rotation of portion 201. However, unconstrained rotation of portion 201 could twist conductors 75 to the point of failure, or at least to the point that their insulation becomes compromised, possibly resulting in a malfunction. Therefore, in the preferred embodiment, rotation of portion 201 is constrained by the cooperation of a tab 93, protruding from the underside of portion 201, with edges 81, 82 of opening 80.

Figure 8:
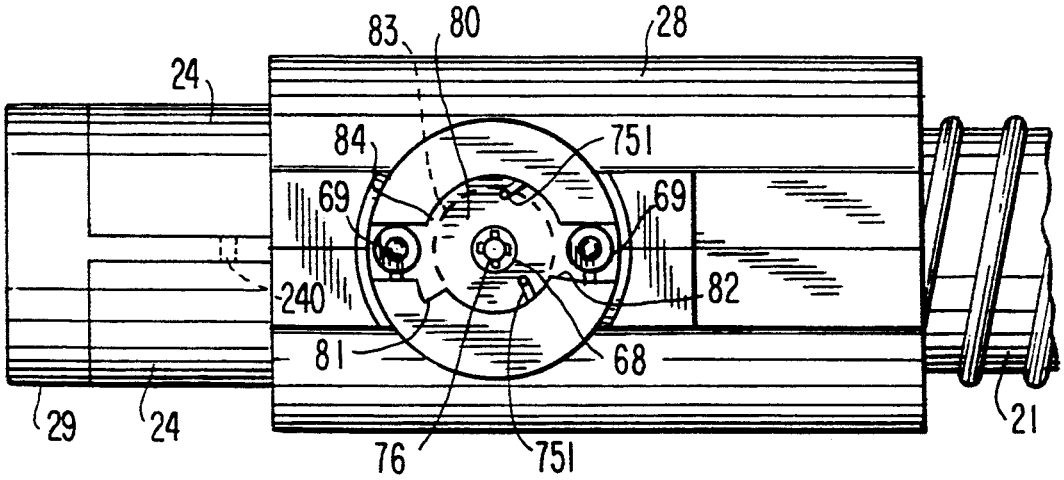
FIG. 8 is a plan view of the top of the body of a hose end fitting according to the present invention, taken from line 8—8 of FIG. 2.
Figure 9:
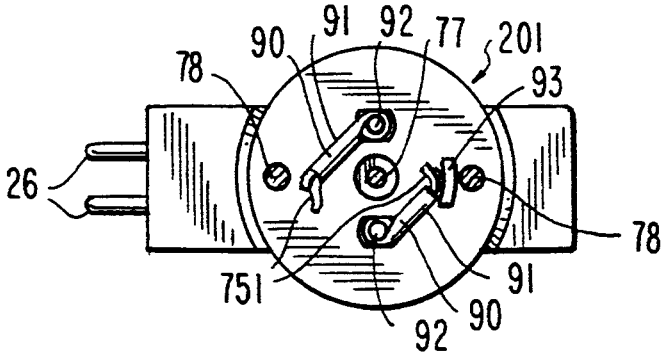
FIG. 9 is a plan view of the underside of the electrical connecting portion of a hose end fitting according to the present invention, taken from line 9—9 of FIG. 2.

As seen in FIG. 8, semicircular opening 66 preferably has a slightly larger radius than semicircular opening 67, as indicated by the dashed arc 83. Tab 93 rides in the area between the edge of opening 66 and dashed arc 83.

Where it reaches edge 81 or 82, it is stopped, preventing further rotation of portion 201. As seen in FIGS. 6 and 8, the edge defining opening 67 is not purely semicircular. Some of edge 610 of body half 61 is removed at 81, while additional material, beyond the straight line otherwise defined by edge 610, is added at 82. These irregular areas are provided to account for the circumferential dimension of tab 93 while still allowing substantially full 180° rotation. If a thin enough, yet strong enough, tab 93 could be provided, it may be possible to provide a purely semicircular opening 67 in straight edge 610.

In FIGS. 2, 6 and 7, portion 201 is adjusted for an installation in which wall outlets 12 have power contacts 16, with prongs 26 facing the wall or nozzle end 29 of end fitting 22. FIG. 3 shows portion 201 adjusted for an installation which lacks power contacts 16, so that a connection to an ordinary electrical outlet 17 must be used. As seen in FIG. 3, prongs 26 have been rotated to face away from nozzle 29 and toward hose 21. An auxiliary power cord 40 for use in this configuration is shown in FIG. 4 and has a standard two-bladed male plug 41 at one end, and a female plug body 42 at the other end. Plug body 42 has two female contacts 43 for mating with prongs 26.

FIG. 5 shows end fitting 22 adjusted as in FIG. 3, with auxiliary power cord 40 attached. As seen, plug body 42 fits over prongs 29 and is fastened to end fitting 22 by the same fastener 202 that prevents rotation of portion 201. When end fitting 22 is used in this configuration, the user can plug nozzle 29 into port 14, and insert plug 41 of cord 40 into outlet 17, providing power to accessories connected to handle/connector 23, without having to trail a hose and a separate power cord.

Thus it is seen that a central vacuum cleaner hose end fitting having a reversible electrical connector body that can be reversed without being disconnected from the end fitting, and which accordingly need not be realigned after being reversed, has been provided. One skilled in the art will appreciate that the present invention can be practiced by other than the described embodiments, which are presented for purposes of illustration and not of limitation, and the present invention is limited only by the claims which follow.

What is claimed is:

1. An end fitting for a first end of a central vacuum cleaner hose for connecting said hose to a wall outlet of a central vacuum cleaner system, said wall outlet having a vacuum port, said hose having a fluid passage and having conductors for transmitting electrical power from said first end thereof to an accessory at a second end thereof, said end fitting comprising:

a body having a bore therethrough, said body having a hose end at which said hose is attached with said bore in fluid communication with said fluid passage, and having a wall end opposite said hose end for insertion into said vacuum port; and an electrical connecting portion on said body, said connecting portion:

having a plurality of contacts each electrically connected to one of said conductors, and being rotatably and permanently affixed to said body for rotation between a first position in which said contacts face said wall end of said body for use when said wall outlet has a source of electrical power for supplying electrical power to said accessory, and a second position in which said contacts face said hose end of said body for use with an auxiliary power cord for supplying electrical power to said accessory from a source spaced from said wall outlet.

2. The end fitting of claim 1 wherein said body comprises:

an inner barrel for mating to said hose; and an outer shell surrounding said inner barrel and a portion of said hose; wherein:

said outer shell has an opening therein;

said electrical connecting portion is outside said outer shell and permanently and rotatably affixed to said barrel through said opening; and said conductors extend from said hose through said opening to said electrical connecting portion.

3. The end fitting of claim 2 wherein:

said barrel comprises a post extending radially therefrom through said opening and having a post diameter;

said electrical connecting portion has a hole therethrough, said hole having a center and a hole diameter;

said post extends through said hole; and said post has an end portion having a diameter larger than said hole diameter for preventing removal of said electrical connecting portion from said post.

4. The end fitting of claim 3 wherein:

said post is made from a polymeric material; and said end portion of said post is formed by deformation of said polymeric material.

5. The end fitting of claim 4 wherein said polymeric material is deformed by ultrasonic welding.

6. The end fitting of claim 4 wherein said polymeric material is deformed by heat staking.

7. The end fitting of claim 3 wherein said end fitting comprises a stop for limiting rotation of said electrical contact portion to prevent damage to said conductors.

8. The end fitting of claim 7 wherein:

said opening has a first semicircular half of a first radius and a second semicircular half of a second radius smaller than said first radius; and said stop comprises a projection on said electrical connecting portion extending into said first semicircular half of said opening and spaced from said center of said hole by said first radius, whereby said electrical connecting portion is prevented from rotating into a position in which said projection extends into said second semicircular half, thereby limiting rotation of said electrical connecting portion to a range of substantially 180°.

9. The end fitting of claim 1 further comprising, when said wall outlet comprises system control contacts for actuating said central vacuum cleaner system, hose control contacts for mating with said system control contacts.

10. The end fitting of claim 9 wherein said hose control contacts are electrically connected to one another, whereby said system is actuated by insertion of said end fitting into said wall outlet.

11. The end fitting of claim 9 wherein, when said hose further comprises control conductors for connection to a control device at said second end, each of said hose control contacts is electrically connected to one of said control conductors, whereby said system is controlled by said control device.

12. The end fitting of claim 1 further comprising a fastener for rotationally fixing said electrical connecting portion in one of said first and second positions.

13. A central vacuum cleaner hose having a first end for connection to a wall outlet of a central vacuum cleaner system and a second end for connection to an accessory, said wall outlet having a vacuum port, said central vacuum cleaner hose comprising:

a carcass having a fluid passage therethrough and having conductors for transmitting electrical power from said first end to said accessory; and an end fitting at said first end for connecting said hose to said wall outlet, said end fitting comprising:

a body having a bore therethrough, said body having a hose end at which said carcass is attached with said bore in fluid communication with said fluid passage, and having a wall end opposite said hose end for insertion into said vacuum port, and an electrical connecting portion on said body, said connecting portion:

having a plurality of contacts each electrically connected to one of said conductors, and being rotatably and permanently affixed to said body for rotation between a first position in which said contacts face said wall end of said body for use when said wall outlet has a source of electrical power for supplying electrical power to said accessory, and a second position in which said contacts face said hose end of said body for use with an auxiliary power cord for supplying electrical power to said accessory from a source spaced from said wall outlet.

14. The central vacuum cleaner hose of claim 13 wherein said body comprises:

an inner barrel for mating to said carcass; and an outer shell surrounding said inner barrel and a portion of said carcass; wherein:

said outer shell has an opening therein;

said electrical connecting portion is outside said outer shell and permanently and rotatably affixed to said barrel through said opening; and said conductors extend from said carcass through said opening to said electrical connecting portion.

15. The central vacuum cleaner hose of claim 14 wherein:

said barrel comprises a post extending radially therefrom through said opening and having a post diameter;

said electrical connecting portion has a hole therethrough, said hole having a center and a hole diameter;

said post extends through said hole; and said post has an end portion having a diameter larger than said hole diameter for preventing removal of said electrical connecting portion from said post.

16. The central vacuum cleaner hose of claim 15 wherein:

said post is made from a polymeric material; and said end portion of said post is formed by deformation of said polymeric material.

17. The central vacuum cleaner hose of claim 16 wherein said polymeric material is deformed by ultrasonic welding.

18. The central vacuum cleaner hose of claim 16 wherein said polymeric material is deformed by heat staking.

19. The central vacuum cleaner hose of claim 15 wherein said end fitting comprises a stop for limiting rotation of said electrical contact portion to prevent damage to said conductors.

20. The central vacuum cleaner hose of claim 19 wherein:

said opening has a first semicircular half of a first radius and a second semicircular half of a second radius smaller than said first radius; and said stop comprises a projection on said electrical connecting portion extending into said first semicircular half of said opening and spaced from said hole by said first radius, whereby said electrical connecting portion is prevented from rotating into a position in which said projection extends into said second semicircular half, thereby limiting rotation of said electrical connecting portion to a range of substantially 180°.

21. The central vacuum cleaner hose of claim 13 further comprising, when said wall outlet comprises system control contacts for actuating said central vacuum cleaner system, hose control contacts for mating with said system control contacts.

22. The central vacuum cleaner hose of claim 21 wherein said hose control contacts are electrically connected to one another, whereby said system is actuated by insertion of said end fitting into said wall outlet.

23. The central vacuum cleaner hose of claim 21 wherein, when said hose further comprises control conductors for connection to a control device at said second end, each of said hose control contacts is electrically connected to one of said control conductors, whereby said system is controlled by said control device.

24. The central vacuum cleaner hose of claim 13 further comprising a fastener for rotationally fixing said electrical connecting portion in one of said first and second positions.

* * * * *